United States Patent [19]

Musgrove et al.

[11] 4,300,798

[45] Nov. 17, 1981

[54] FOLDABLE CHAIR WITH SUN SHADE AND TRAY

[76] Inventors: Donovon E. Musgrove; Wilbur D. Vos, both of Sully, Iowa 50251

[21] Appl. No.: 111,588

[22] Filed: Jan. 14, 1980

[51] Int. Cl.[3] ..... A47C 7/66

[52] U.S. Cl. ..... 297/184; 297/162

[58] Field of Search ..... 297/184, 148, 170, 162

[56] References Cited

U.S. PATENT DOCUMENTS

| | | | |
|---|---|---|---|
| 539,041 | 5/1895 | Doolittle et al. | 297/184 X |
| 1,211,527 | 1/1917 | Berndt | 297/170 X |
| 1,921,460 | 8/1933 | Euring | 297/184 X |
| 1,923,517 | 8/1933 | Swaninger | 297/184 X |
| 2,982,562 | 5/1961 | Gladstein | 297/184 X |
| 2,994,366 | 8/1961 | Hoch | 297/162 X |
| 3,050,280 | 8/1962 | Regan | 297/184 X |
| 3,265,436 | 8/1966 | Bombard et al. | 297/162 |
| 3,879,086 | 4/1975 | Moceri | 297/217 |
| 4,201,416 | 5/1980 | Vanderminden | 297/184 |

*Primary Examiner*—Francis K. Zugel
*Attorney, Agent, or Firm*—Zarley, McKee, Thomte, Voorhees & Sease

[57] ABSTRACT

A foldable chair with a seat portion, a back portion and leg portions is disclosed herein. A sun shade frame is mounted on the upper rear portion of the back portion of the chair. A mounting bracket is secured to the back of the chair, and a vertical post is slidably and rotatably supported by the mounting bracket. Adjustment means are provided on the bracket for changing the angular disposition of the post from a substantially vertical position to an inclined position in alignment with the plane of the back portion of the chair. A sun shade frame is pivotally secured to the upper portion of the post by a hinge means which permits the sun shade to be pivoted from a substantially horizontal operating position on one side of the post to a substantially vertical storage position on the other side of the post. A tray means is secured to one of the leg portions of the chair by a second mounting bracket. This mounting bracket permits the tray to be both vertically and rotatably positioned with respect to the chair. The tray is mounted on an L-shaped support arm which extends through the second mounting bracket, and the tray is adapted to be rotatable about a horizontal axis on the support arm.

3 Claims, 9 Drawing Figures

FOLDABLE CHAIR WITH SUN SHADE AND TRAY

BACKGROUND OF THE INVENTION

Foldable lawn chairs exist in the prior art but they are normally not equipped with either a sun shade to shelter the chair from the sun, nor are they equipped with a collapsible tray to permit the chair to be used for either working or dining. Those chairs that are equipped with either a sun shade or a tray are of complex construction and are not easily adjustable. In addition, the sun shades and trays of the prior art are not easily foldable with the chair for storage purposes. Further, many chairs of the prior art make it difficult for a person to get into and out of a chair particularly when a tray is used.

SUMMARY OF THE INVENTION

This invention provides a sun shade which is adaptable for attachment to the upper back portion of a chair or the like by means of a mounting bracket. The mounting bracket slidably and rotatably supports a vertical post and permits the post to be pivoted from a vertical operating position to an inclined storage position substantially parallel to the plane of the back of the chair. A hinge element connects a sun shade frame with the upper portion of the post and permits the sun shade frame to be moved from a substantially horizontal operating position on one side of the post to a vertical storage position on the other side of the post.

A tray means is mounted on one leg of the foldable chair by means of a second mounting bracket. An L-shaped arm with vertical and horizontal portions is slidably and rotatably received within the bracket to permit both the elevation and the angular position of the tray to be selectively adjusted. The normally horizontal tray can be rotated to a vertical position on the horizontal portion of the arm to facilitate storage when the chair is moved to its foldable and collapsed position.

The device of this invention provides a foldable chair with sun shade and tray wherein both the tray and the sun shade are easily adjustable. Further, this invention provides a chair device which permits easy entrance or departure from the chair. Further, the device of this invention provides a combination foldable chair with sun shade and tray which can be easily folded for storage purposes.

These and other objectives will be apparent to those skilled in the art.

DESCRIPTION OF THE PREFERRED EMBODIMENT

Figures 1, 2, 3:
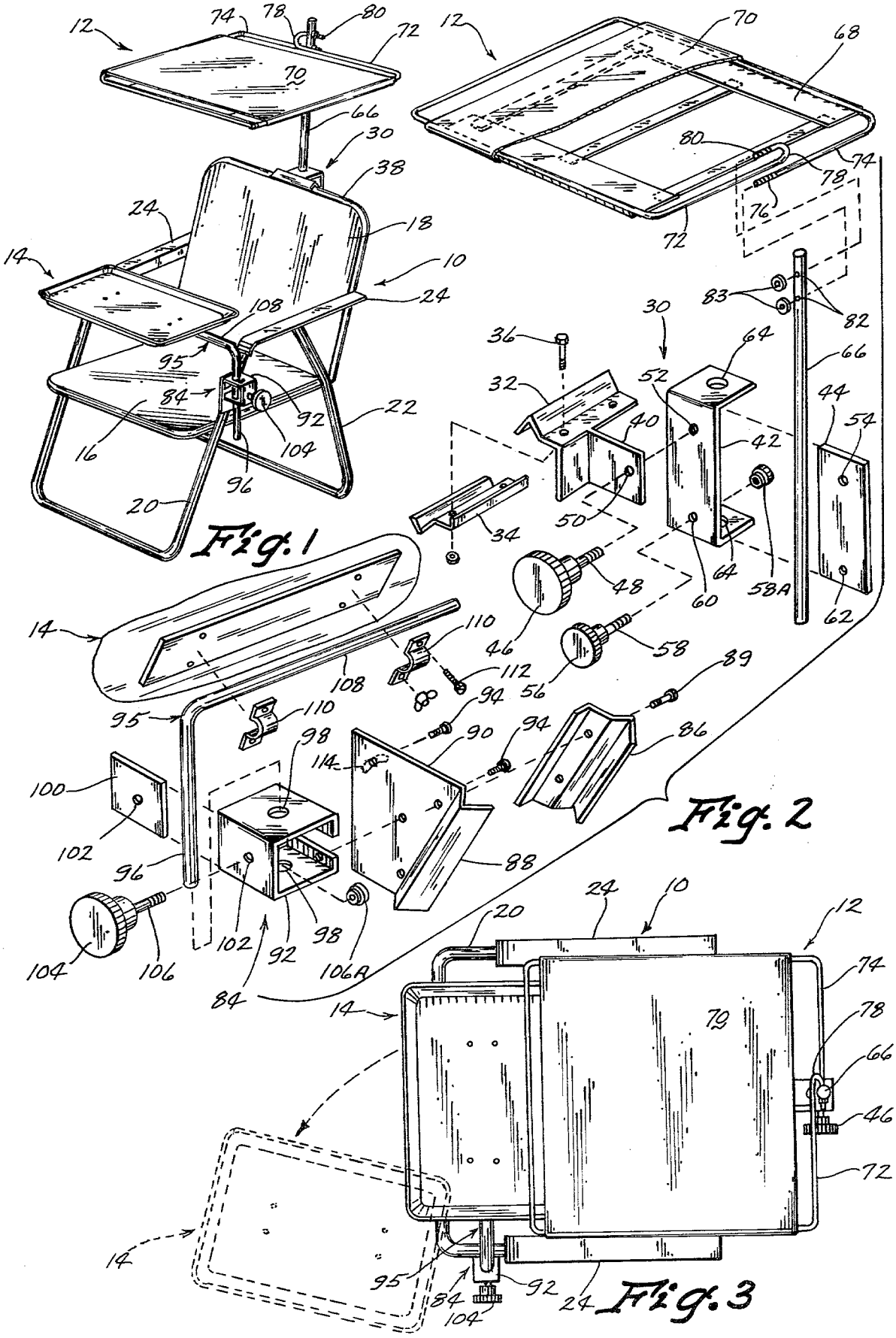
FIG. 1 is a perspective view of the device of this invention.
FIG. 2 is an exploded schematic view of the tray and sun shade elements and the mounting brackets for each shown at an enlarged scale.
FIG. 3 is a top plan view of the device shown in FIG. 1.

The numeral 10 designates a conventional, foldable lawn chair with a sun shade 12 and a tray 14 mounted thereon. Chair 10 is comprised of a conventional seat portion 16, back portion 18 and legs 20 and 22. Conventional arm portions 24 can also be employed. The foregoing components are pivotally connected together in conventional fashion by means of pins 26 and linkage 28.

Figures 4, 5, 6, 7, 8, 9:
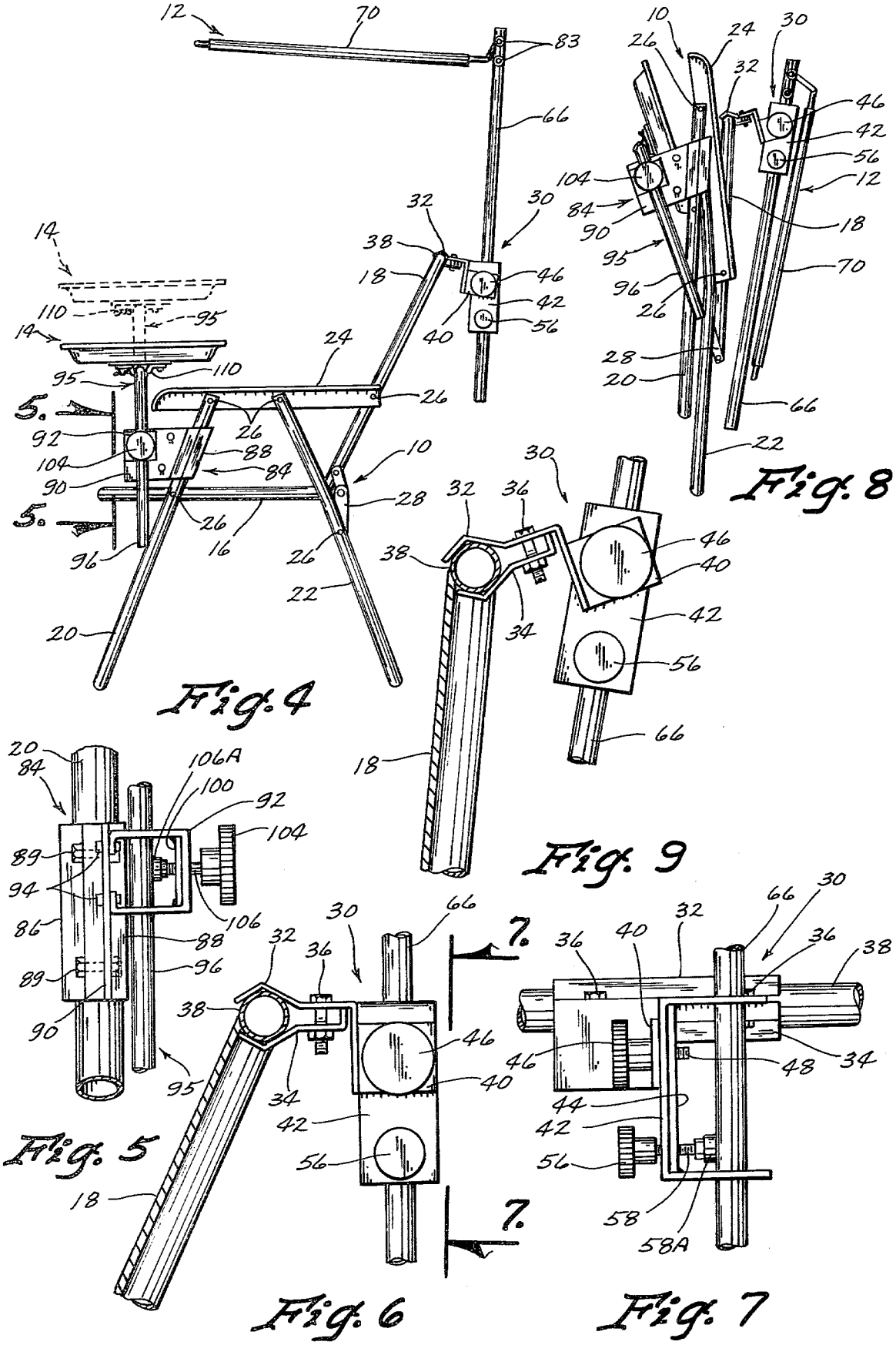
FIG. 4 is a side elevational view thereof in an operating position.
FIG. 5 is a partial elevational view of the mounting bracket for the tray as viewed on line 5—5 of FIG. 4.
FIG. 6 is a partial sectional view through the upper top portion of the back of the chair showing the mounting bracket for the sun shade.
FIG. 7 is a rear elevational view of the mounting bracket for the sun shade as seen on line 7—7 of FIG. 6.
FIG. 8 is a side elevational view of the chair structure in its folded storage condition.
FIG. 9 is a view similar to that of FIG. 6 but wherein the mounting bracket has been moved to its storage position.

Bracket 30 includes clamp elements 32 and 34 which can be secured together by conventional nut and bolt assemblies 36 to the upper horizontal rail 38 of the back portion 18 of chair 10. A flange 40 extends rearwardly from clamp element 32. A C-shaped bracket 42 with a stiffener plate 44 positioned therein is adapted to be mounted adjacent one side of flange 40. As seen in FIG. 7, knob 46 with a threaded stud bolt 48 extends through aperture 50 in flange 40 for threaded engagement in the threaded apertures 52 and 54 in bracket 42 and plate 44. respectively. By loosening or tightening the threaded engagement of knob 46 and stud bolt 48 in the threaded apertures 52 and 54, the pivotal position of bracket 42 with respect to flange 40 can be selectively adjusted.

A knob 56 with a threaded stud bolt 58 threadably extends through threaded apertures 60 and 62 in bracket 42 and plate 44 as shown in FIGS. 2 and 7. A bushing 58A is mounted on the free end of the threaded stud bolt 58.

As shown in FIG. 2, apertures 64 appear in bracket 42 and are adapted to slidably receive elongated post 66. Bushing 58A is adapted to bear against post 66 to retain it in position on bracket 42 when the knob 56 and the threaded stud bolt 58 are tightened in the threaded apertures 60 and 62.

A sun shade frame 68 has canvas material 70 secured thereto in any convenient fashion. Frame 68 includes rods 72 and 74 which extend towards each other. Rod 74 terminates in a threaded hinge portion 76, while rod 72 terminates in a loop 78. The loop 78 has a free end 80 which is also threaded. Hinged portion 76 and the free end 80 are adapted to be inserted through apertures 82 in the upper end of post 66. Conventional nuts 83 serve to retain the hinge portion 76 and the free end 80 in operative connection with the post 66. It should be noted that the free end 80 of loop 78 and the hinge 76 of rod 74 extend through apertures 82 and post 66 from the same direction. As seen in FIG. 4, the weight of frame 68 forces the loop 78 into binding engagement with post 66 when the frame 68 is in its operating position. The frame then can be rotated upwardly and rearwardly to the storage position of FIG. 8 whereby the frame 68 then dwells on the opposite side of the post 66. Hinge portions 76 is first detached and slid out of post 66, then loop 78 is pivoted about free end 80. The loop 78 moves upwardly and over the upper end of post 66 as the frame 68 is moved from the position of FIG. 4 to the position of FIG. 8.

A bracket 84 serves to support the tray 14 on the chair 10. Bracket 84 has clamp portions 86 and 88 which are adapted to be secured together by bolts 89 to effect a clamping relationship with leg 20 of chair 10. A flange 90 extends forwardly from clamp portion 86. A C-shaped bracket 92 is secured to flange 90 by screws 94. An L-shaped arm 95 with a vertical post portion 96 is mounted on bracket 92 by means of the vertical post portion 96 extending through aligned apertures 98 in the bracket 92. A stiffener plate 100 is mounted within the bracket 92 as shown in FIGS. 2 and 5. Registering threaded apertures 102 appear in bracket 92 and plate 100. Knob 104 has threaded stud bolt 106 which is threadably received within the threaded apertures 102. A bushing 106A is mounted on the free end of the threaded stud bolt 106 to bear against the vertical post portion 96 of the L-shaped arm 95 to permit selective height adjustment of the post portion 96 in the bracket 92.

The L-shaped arm 95 has a horizontal portion 108. Brackets 110 embrace the horizontal portion 108 and are attached to the tray 14 by screws 112. The brackets 110 cause the tray to be frictionally mounted on the arm 95 so that the tray can be selectively rotated to any desired position with respect to the chair 10.

It is desirable that the bracket 92 be mounted on leg 20 so that post portion 96 is substantially vertical. An arcuate slot 114 is shown in dotted lines in flange 90 in FIG. 2. Such an arcuate slot would permit an angular adjustment between the flange 90 and bracket 92 to be selectively made.

In operation, the sun shade frame 68 normally dwells in the horizontal position shown in FIGS. 1 and 4. The weight of the frame 68 causes the loop 78 to bind against the forward side of the post 66. By loosening knob 46, the post 66 can be raised and lowered, and the post 66 can be rotated about its longitudinal axis.

In operation, the tray 14 normally assumes the general position shown by the solid lines in FIGS. 1 and 4. The height of the tray can be selectively adjusted by actuating the knob 104 to permit the vertical post portion 96 to be raised or lowered within the apertures 98 of bracket 92. The tray 14 can be rotated to the position shown by the dotted lines in FIG. 3 to permit a person to exit the chair.

When it is desired to store the chair, the frame 68 is rotated from the position in FIG. 4 to the position of FIG. 8 as described heretofore. The knob 46 is loosened and then retightened to permit the post 66 to be moved from the positions of FIGS. 4 and 6 to the positions of FIGS. 8 and 9, respectively. Similarly, the tray 14 can be lowered with respect to the chair by loosening knob 104 which would permit vertical post portion 96 to move downwardly in apertures 98 of bracket 92. The tray then can be rotated to a substantially vertical position by means of brackets 110 as described heretofore. The chair can then be completely folded to the position of FIG. 8.

The bushings 58A and 106A ordinarily will frictionally engage the posts 66 and 96, respectively, to permit either the sun shade 12, or the tray 14 to be rotated about a vertical axis to accommodate the convenience of the person sitting in the chair.

Either the tray or the sun shade can be removed from the respective brackets by loosening knob 56 of bracket 42 or knob 104 of bracket 84 so that post portion 96 or post portion 66 can be withdrawn from the apertures through which they extend.

Thus, from the foregoing, it is seen that this invention will accomplish all of its objectives.

We claim:

1. A sun shade for a chair or the like comprising: an upright support post, and a sun shade frame having horizontally disposed parallel rods extending towards said post from opposite sides of said frame, one of said rods terminating in a straight portion which extends through said post, the other of said rods terminating in a hinge comprising a loop element having a free end pivotally extending through said post and a portion which binds against said post below said free and when said frame is in a first operative forwardly horizontal position on one side of said post and said loop element portion passes over the top of said post to the opposite side thereof when said straight portion of said first rod is removed from said post and said frame is moved to a second vertical storage position.

2. The sun shade of claim 1 wherein said free end of said loop element extends through said post in the same direction as said first straight portion.

3. The sun shade of claim 1 wherein a support bracket is secured to said post below said frame; said support bracket slidably and pivotally receiving said post, means on said support bracket for changing the angular relationship between said support bracket and said post from an operating position to a storage position.

* * * * *